US011623161B2

(12) United States Patent
Gates et al.

(10) Patent No.: US 11,623,161 B2
(45) Date of Patent: Apr. 11, 2023

(54) AMAZING GRACE FLYING TOY

(71) Applicants: Randy S Gates, Buford, GA (US); Andrew Steven Gates, Buford, GA (US)

(72) Inventors: Randy S Gates, Buford, GA (US); Andrew Steven Gates, Buford, GA (US)

( * ) Notice: Subject to any disclaimer, the term of this patent is extended or adjusted under 35 U.S.C. 154(b) by 0 days.

(21) Appl. No.: 17/403,773

(22) Filed: Aug. 16, 2021

(65) Prior Publication Data

US 2023/0051679 A1 Feb. 16, 2023

(51) Int. Cl.
*A63H 33/18* (2006.01)
*A63H 27/00* (2006.01)

(52) U.S. Cl.
CPC ..... *A63H 33/18* (2013.01); *A63H 27/001* (2013.01)

(58) Field of Classification Search
CPC ..... A63H 33/18; A63H 33/185
See application file for complete search history.

(56) References Cited

U.S. PATENT DOCUMENTS 4,850,923 A * 7/1989 Etheridge ..... A63H 33/18 473/589
5,067,922 A * 11/1991 McMahon ..... B65D 81/3886 446/61
5,397,261 A * 3/1995 Malewicki ..... B65D 81/3886 473/589
5,810,637 A * 9/1998 Mileti ..... A63H 33/18 446/61
6,048,245 A * 4/2000 Forti ..... A63H 33/18 446/61
6,083,128 A * 7/2000 Young ..... A63B 43/02 473/576
6,679,748 B2 * 1/2004 Forti ..... A63H 33/18 446/61
8,808,122 B2 * 8/2014 Lopatka ..... A63B 67/06 446/61
2014/0329432 A1 * 11/2014 Lopatka ..... A63H 33/18 220/739

* cited by examiner

*Primary Examiner* — John A Ricci
(74) *Attorney, Agent, or Firm* — Randy S. Gates; Andrew Steven Gates

(57) ABSTRACT

This invention is a tubular shaped flying toy comprised of a polypropylene (foam) main cylindrical body with a heavy plastic ring supported front end. The main foam body is held in place to the plastic ring support with the help of rubber bracelet bands that stretch around the outside of the front end of the toy where the foam body stretches onto the hard plastic ring. The toy is thrown with a baseball type throwing motion, and provides a graceful, smooth flight.

1 Claim, 2 Drawing Sheets

AMAZING GRACE FLYING TOY

BACKGROUND OF INVENTION

The field of the invention is flying toys.

The invention is a flying toy which sails through the air when thrown (with a baseball throwing type motion) by an individual.

It is tubular in its shape and structure. There are other existing patents for tubular shaped flying toys, but none with the structural design which I use. My design is simple in nature and allows for easy assembly of the finished product.

RELATED ART DESCRIPTIONS

U.S. Pat. No. 6,679,748

This patent gives a flying toy description that is very, very broad in scope. It suggests many different types of materials that can be used in the structure of the toy. It also discusses the many different dimensions that can be used in the construction of the toy. It also suggests various designs for its final product.

U.S. Pat. No. 5,810,637

This patent is probably the invention which is the closest to the design of the invention which I have created. There are however a couple of notable differences.

The first main difference lies in the leader/head portion of the toy. In my design, the hard "inner plastic head" is overlapped by the foam "cylindrical main body", which is then overlapped by the "outer rubber bracelet bands". Both, the cylindrical main body, and the outer rubber bracelet bands are comprised of materials that stretch. Because they stretch, these components fit "snugly" on top of one another, and there is no need for an adhesive to be used. The design of the head portion of U.S. Pat. No. 5,810,637 is a totally different concept.

The second difference in the design lies in the tail portion of the toy. My design speaks of a tail portion that is not collapsible, but rather retains its tubular form before, during, and after its flight. U.S. Pat. No. 5,810,637 speaks of a collapsible tail design. My tail portion is flexible as it is made of a polypropylene material.

In the description of the design of the flying toy which I have created, I try to be as specific as possible concerning the materials that I use in its fabrication. I also try to be concise when it comes to the description of the parts which comprise the final assembled toy. I also try to be concise in describing how the toy is assembled. As far as the dimensions of the toy parts of the final assembled product, the final toy itself may have slight variances from the dimensions which I show herein this application.

Depending upon what may be deemed as a slightly better design for flight improvement, very slight adjustments may be made to the dimensions.

BRIEF SUMMARY OF THE INVENTION

This invention is a tube-shaped flying toy that has a specific, unique, symmetrical design, a design unlike any other patented tubular flying toy. It is unique in the use of one of its component parts (the outer rubber bracelet bands) and is unique in the way the product is assembled.

The toy's primary use is for entertainment and fun. It can, however, at the same time be used to advertise, as inscriptions can be made on the outer rubber bracelet bands.

DESCRIPTION OF DRAWINGS

The drawings of the flying toy are illustrated on two pages. The first page of drawings illustrates the component parts of the toy, while the second page of drawings shows pictures of the assembled product, from two different viewpoints.

Page One.

On page two, FIG. 4, a side view of the toy, with a slight slant is shown.

DETAILED DESCRIPTION OF THE AMAZING GRACE FLYING TOY

The Amazing Grace Flying Toy is a "flying tube" toy with a unique design. The toy is comprised of three components which are manually assembled. The 3 parts include the cylindrical foam body, the inner plastic head support, and the outer rubber bracelet bands. It is a simple design, yet a symmetrical design which allows for smooth sailing when thrown (using the same motion which is used for throwing a baseball or a glider plane).

The enclosed two pages of drawings show exactly how the 3 parts fit together to form the product.

First, the main foam body fits snugly over the inner plastic head support. Then, the outer rubber bands fit snugly on top of the plastic head support and on top of the foam body. The outer rubber bracelet bands accomplish 2 things. It provides additional weight at the front (or the head) of the toy, and it also helps to keep a secure fit of the foam body over top of the inner plastic head support. Because of the stretchable nature of the foam body and the outer rubber bands, both components stretch over the top of the inner plastic head.

Figure 1:
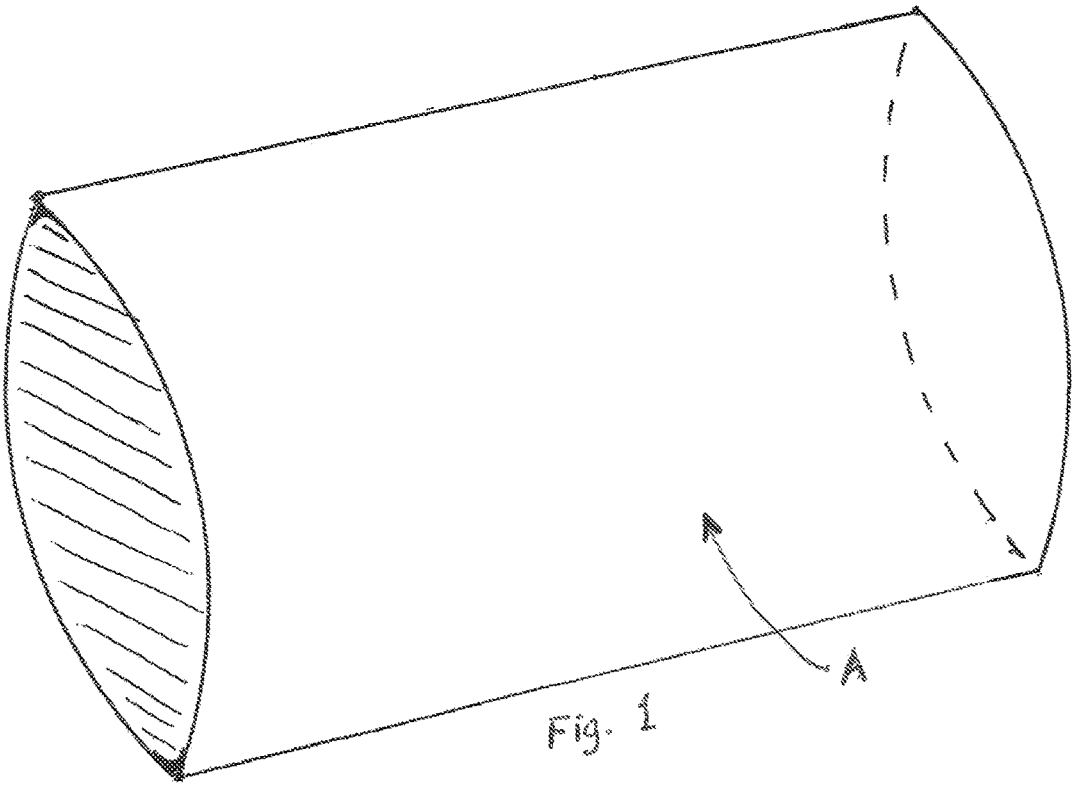
FIG. 1, shows the cylindrical main foam body (also assigned the letter A).

The estimated dimensions of the 3 components are as follows:

FIG. 1 Cylindrical Main Foam Body—5⅜ inches in length, foam thickness of about 1/16 inch, the diameter of the cylinder is about 2¾ inches.

Figure 2:
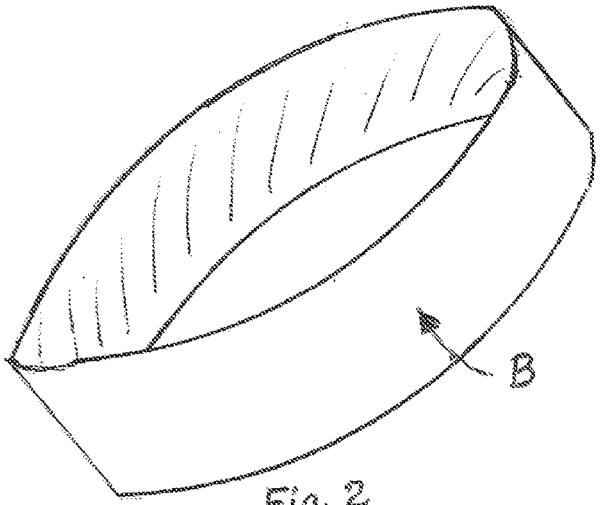
FIG. 2 on that page shows the inner plastic head support (also assigned the letter B). Also, on the same page.

FIG. 2 Inner Plastic Head Support—The width is about 1 inch, the thickness is about 1/16 inch, and the diameter of the circular shape is slightly less than 2¾ inches.

Figure 3:
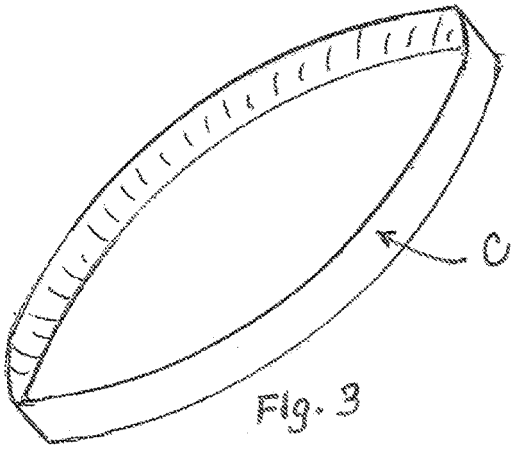
FIG. 3 shows the outer rubber bracelet band(s) (also assigned the letter C).
Figure 4:
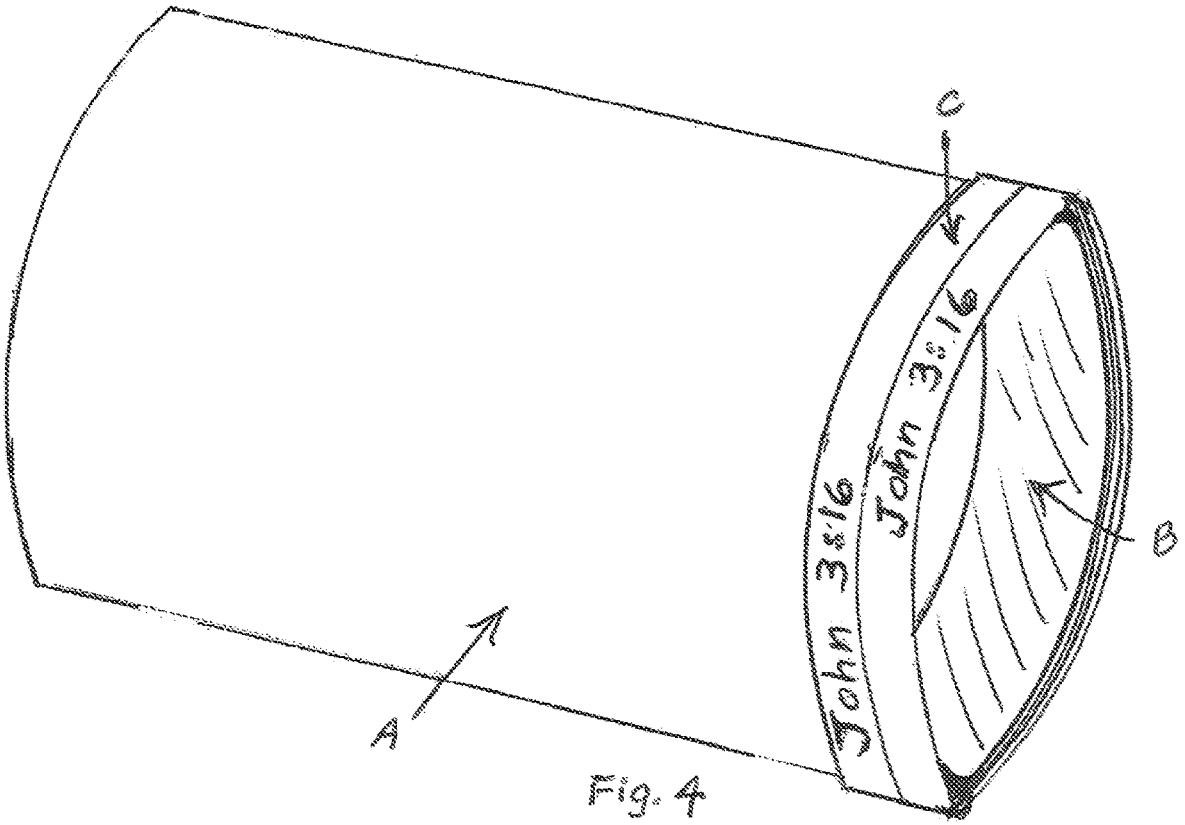
Figure 5:
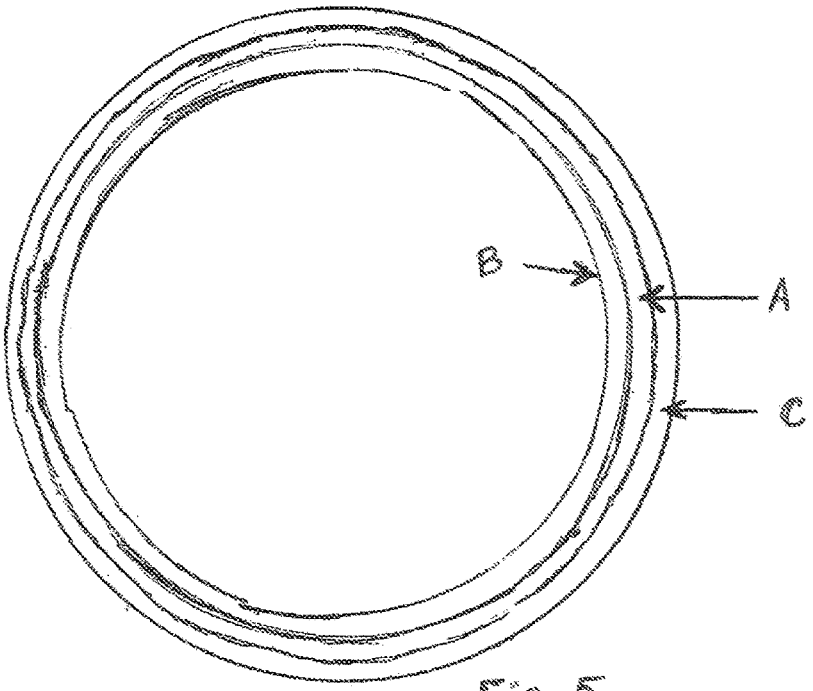
In FIG. 5, a top view of the front end of the toy, looking down through the open cylinder of the main body is shown.

FIG. 3 Outer Rubber Bracelet Bands—½ inch in width, thickness of about 1/16 inch, and a diameter while unstretched and lying in a circular shape of about 2½ inches.

When assembling the product, either 1 or 2 of the outer rubber bracelet bands can be used, depending upon the amount of weight that is desired for the finished product.

When thrown, the toy makes an amazingly graceful flight, and thus the name of the Amazing Grace Flying Toy.

The Outer Rubber Bracelet Bands can come in various colors, and words and numbers can be placed on the outer surface of each. Hence, the finished product can be used for promotional or advertising purposes, if desired.

I claim:

1. A flying toy, which comprises:

a cylindrical foam body, which includes a front end, a rear end, and a hollow interior extending from the front end to the rear end;

a rigid head support ring at the first end of the cylindrical foam body, the rigid head support ring of an outer diameter which is slightly larger than an unstretched inner diameter of the foam body, so that the support ring may be placed into the interior of the foam body and held by friction;

at least one outer bracelet band at the first end of the foam body, the at least one outer bracelet band of an elastomeric material and of an inner diameter which is slightly smaller than the front end of the foam body, so that the at least one bracelet band may be placed over the exterior of the foam body at the location of the head support ring and held by friction; so that the toy may be thrown and fly through the air.

* * * * *